US006026957A

United States Patent [19]

Bauer et al.

[11] Patent Number: 6,026,957

[45] Date of Patent: Feb. 22, 2000

[54] FLEXIBLE PAPER COVERED PACKAGE AND PROCESS FOR PRODUCING SAME

[75] Inventors: Rainer Richard Bernd Bauer, Wiesbaden; Khalid Berrada, Bad Soden; Bruce Kevin Bitowft, Glashutten; Bettina Hoinke, Schwalbach; Jorg Andreas Muller, Bonn; Martin Zethoff, Kelkheim, all of Germany

[73] Assignee: The Procter & Gamble Company, Cincinnati, Ohio

[21] Appl. No.: 08/981,316

[22] PCT Filed: Jun. 7, 1996

[86] PCT No.: PCT/US96/09673

§ 371 Date: May 13, 1998

§ 102(e) Date: May 13, 1998

[87] PCT Pub. No.: WO96/41752

PCT Pub. Date: Dec. 27, 1996

[30] Foreign Application Priority Data

Mar. 27, 1996 [EP] European Pat. Off. ..... 96104831

[51] Int. Cl.[7] ..... B65D 71/06

[52] U.S. Cl. ..... 206/494; 53/397; 53/438; 53/443; 53/447; 206/83.5; 229/87.01

[58] Field of Search ..... 206/494, 83.5; 53/397, 438, 443, 447; 383/32; 229/87.01

[56] References Cited

U.S. PATENT DOCUMENTS

| | | | |
|---|---|---|---|
| 1,381,904 | 6/1921 | Christensen | 229/87.01 |
| 2,047,809 | 7/1936 | Uslinger | 229/23 |
| 2,268,151 | 12/1941 | Huye | 223/71 |
| 2,895,272 | 7/1959 | Krukonis | 53/397 |
| 3,248,039 | 4/1966 | Locke | 229/37 |
| 3,330,089 | 7/1967 | Uematsu | 53/24 |
| 3,458,036 | 7/1969 | James | 206/65 |
| 3,465,876 | 9/1969 | Titchenal et al. | 206/83.5 |
| 3,541,752 | 11/1970 | Ness | 53/24 |
| 3,562,392 | 2/1971 | Mylius | 206/46 |
| 3,645,759 | 2/1972 | Heiligaman | 99/174 |
| 3,809,235 | 5/1974 | Edwards et al. | 206/499 |
| 3,946,867 | 3/1976 | McGuire et al. | 206/450 |
| 4,177,895 | 12/1979 | Shelton | 206/386 |
| 4,533,587 | 8/1985 | Rias | 53/436 |
| 4,553,668 | 11/1985 | James et al. | 206/391 |
| 4,555,017 | 11/1985 | Backmore | 206/83.5 |
| 4,624,991 | 11/1986 | Haas | 525/209 |
| 4,799,350 | 1/1989 | Rias | 53/399 |
| 4,821,491 | 4/1989 | Rias | 53/438 |
| 4,920,731 | 5/1990 | Rimondi et al. | 53/556 |
| 4,934,535 | 6/1990 | Muckenfufhs et al. | 206/610 |
| 4,941,755 | 7/1990 | Cazes | 383/119 |

(List continued on next page.)

FOREIGN PATENT DOCUMENTS

| | | | |
|---|---|---|---|
| 0 391 460 | 10/1990 | European Pat. Off. | B65D 83/08 |
| 0 618 148 A1 | 10/1994 | European Pat. Off. | B65D 71/00 |
| 24 29 903 | 6/1974 | Germany | B26D 7/18 |
| 26 14 235 | 10/1977 | Germany | B65D 85/16 |
| WO 91/08962 | 6/1991 | WIPO | B65D 33/10 |

*Primary Examiner*—Stephen P. Garbe
*Attorney, Agent, or Firm*—Leonard W. Lewis

[57] ABSTRACT

A package comprising an array of at least two substantially parallelepipedal packs, the packs including compressed flexible articles encased in a flexible bag, and a flexible paper covering disposed adjacent the whole of the bottom panel of the array and a substantial part of the side panels of the array corresponding to at least 30 percent of the height of the array. The paper covering is held under tension around the array so as to create a strong and protective outer casing for the array.

18 Claims, 4 Drawing Sheets

U.S. PATENT DOCUMENTS

| | | | |
|---|---|---|---|
| 4,946,093 | 8/1990 | Moorman | 229/128.19 |
| 4,966,286 | 10/1990 | Muckenfuhs | 206/610 |
| 4,972,659 | 11/1990 | Cazes | 53/556 |
| 5,022,216 | 6/1991 | Muckenfuhs et al. | 53/438 |
| 5,036,978 | 8/1991 | Frank et al. | 206/494 |
| 5,048,687 | 9/1991 | Suzuki et al. | 206/497 |
| 5,050,742 | 9/1991 | Muckenfuhs | 206/610 |
| 5,054,619 | 10/1991 | Muckenfuhs | 206/610 |
| 5,065,868 | 11/1991 | Cornelissen et al. | 206/494 |
| 5,111,931 | 5/1992 | Gombos et al. | 206/83.5 |
| 5,150,561 | 9/1992 | Muckenfuhs et al. | 53/438 |
| 5,271,498 | 12/1993 | Gillespie | 206/326 |
| 5,350,063 | 9/1994 | Berdan, II | 206/321 |
| 5,361,905 | 11/1994 | McQueeny et al. | 206/494 |
| 5,380,094 | 1/1995 | Schmidt et al. | 206/494 |
| 5,507,130 | 4/1996 | Young et al. | 53/438 |
| 5,642,602 | 7/1997 | Young et al. | 53/438 |
| 5,644,897 | 7/1997 | Young et al. | 53/438 |
| 5,666,787 | 9/1997 | Young et al. | 53/438 |
| 5,678,389 | 10/1997 | Henry | 53/447 |
| 5,722,774 | 3/1998 | Hartz | 206/494 |
| 5,732,531 | 3/1998 | Silva et al. | 229/87.01 |
| 5,735,104 | 4/1998 | Odenthal | 53/397 |
| 5,934,470 | 8/1999 | Bauer et al. | 206/494 |

FIG. 2
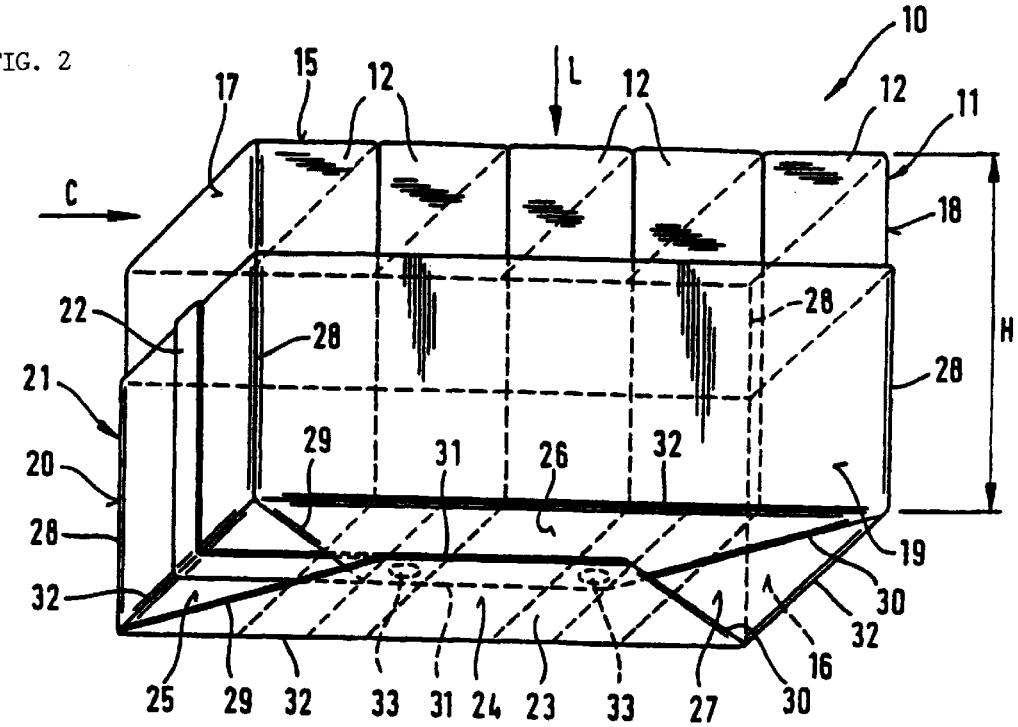
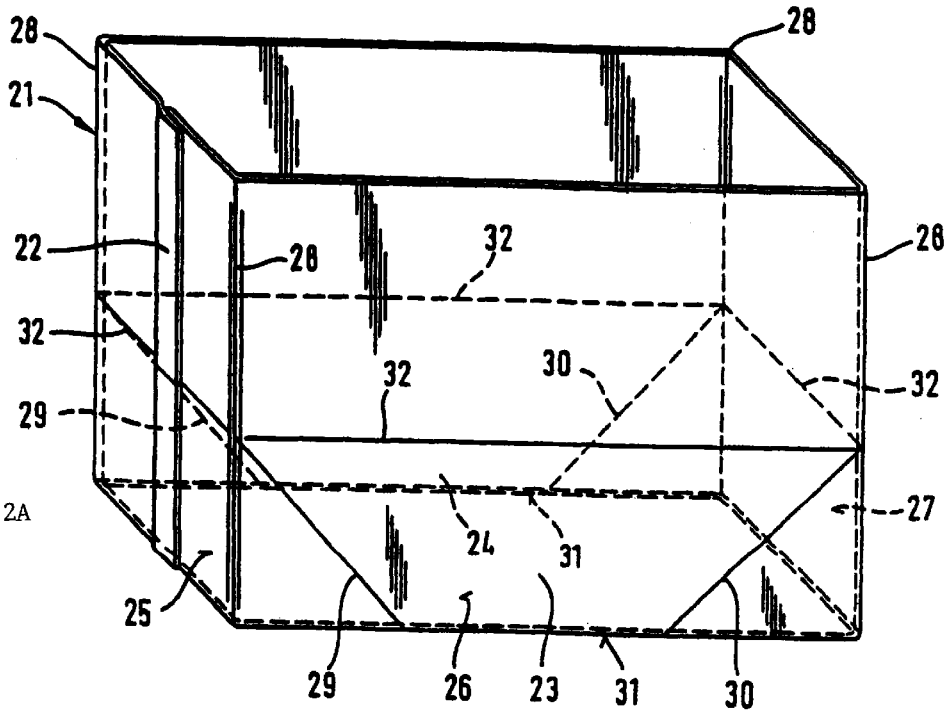
FIG. 2A

FIG. 3
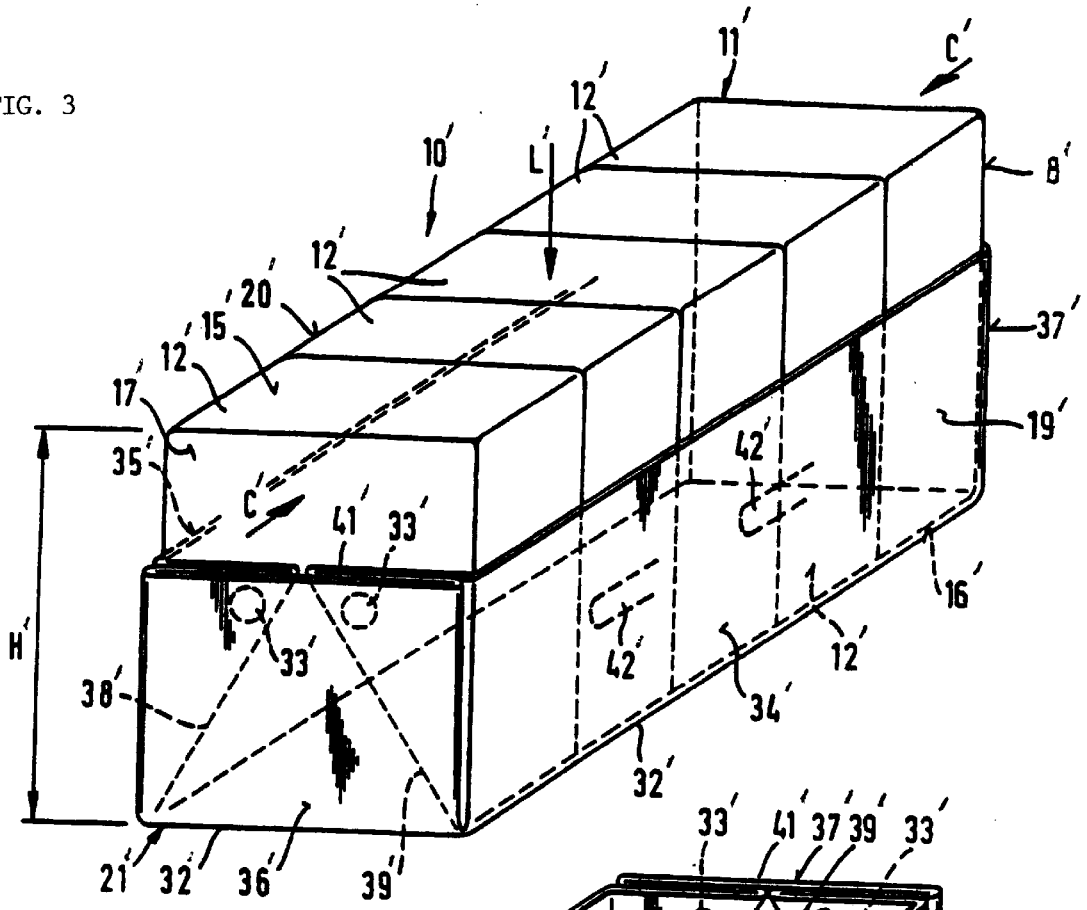
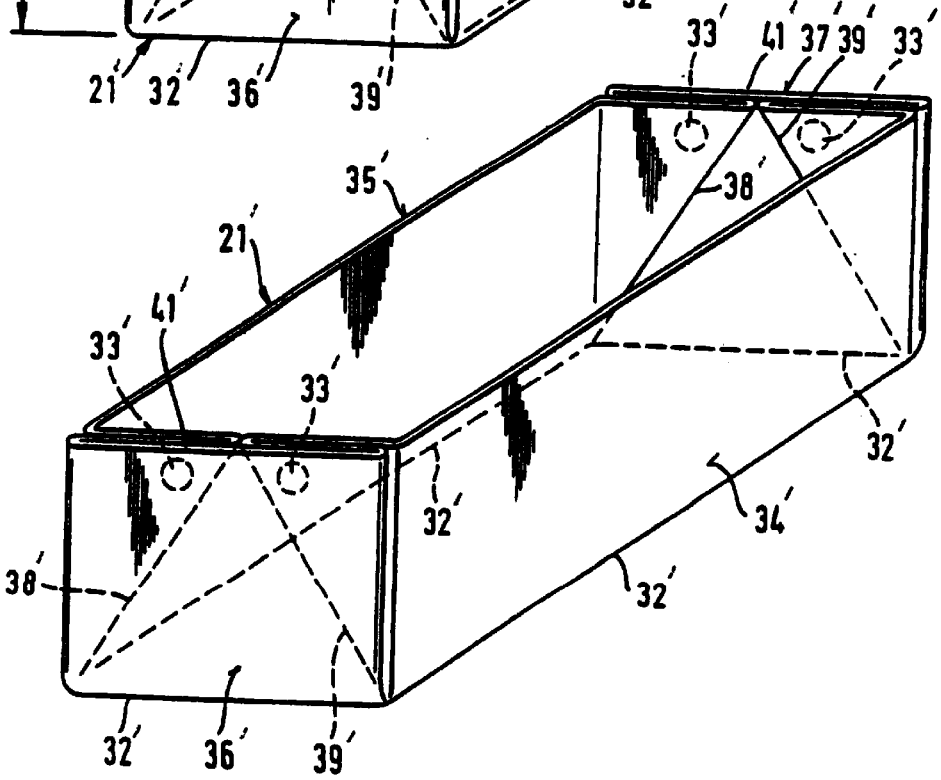
FIG. 3A

FLEXIBLE PAPER COVERED PACKAGE AND PROCESS FOR PRODUCING SAME

FIELD OF THE INVENTION

The invention relates to an array of packs comprising compressed flexible articles encased in flexible bags which are covered by a flexible paper covering to form a package and to a process for wrapping the flexible paper covering under tension around the array of packs.

BACKGROUND OF THE INVENTION

It is widely known in the art to pack an array of packs comprising compressed flexible articles encased in flexible bags in cardboard cases for ease of handling, storage and transport. Cardboard, however, is heavy, requires space and has less flexibility for storage since it is rigid and in use continues to occupy the same amount of space even when nearly empty. The space inside these cardboard cases cannot be fully utilised because of the variations in the pack dimensions resulting from the production processes and the tolerances imposed by the usual automatic mechanical packaging systems. The problem of utilisation of space is becoming more and more important with the increasingly widespread use of pallets of standard dimensions resulting from the demands of large manufacturing, distribution and sales organisations. Furthermore, due to the deviations in the pack dimensions resulting from the packing of compressible flexible articles into flexible bags, the cardboard cases need to be over-dimensioned. As a consequence of this over-dimensioning, arrays of packs on the bottom of pallets are incapable of supporting the imposed loads when pallets of products are stacked or grouped three pallets high. Therefore, the cardboard cases must be designed to support the extra loads.

Prior art developments include WO 94/00362 which discloses a plurality of flexible packs placed side by side and held together by means of detachable adhesive tapes. The configuration avoids the use of corrugated cardboard boxes, but offers little in terms of support, stability and protection for the plurality of packs. Consequently, damage can occur quite easily.

EP 0 313 721 B1 discloses a process for erecting packaging on rigid cubic material. The method uses a set of constructional elements produced from packaging cardboard blanks fitted with adhesive flaps and results in the formation of at least one flat basal frame structure constructed without a packaging base. A reduction in the level of packaging material occurs and improved stability results, but the main aim of the invention is to use packaging cardboard and not paper as a packaging material.

EP 0 477 487 B1 discloses a process for producing a package consisting of a dimensionally stable framework with at least one open frame section which supports the material to be packed at the base. In particular, a strip of stiff, stretchfree packaging material is pulled off a supply roll, placed tightly with its edge projecting against the material to be packed, closed to form a surrounding strap and folded angled inwards into the basal plane of the material to be packed. Similarly, a reduction in the level of packaging material results. Nevertheless, the main aim of this invention is to produce a stable framework supporting the material to be packed without using constructional elements. Cardboard is the only example given as a packaging material.

EP 0 675 042 A1 claims a process leading to a rigid package comprising two spaced apart surrounding straps at the top and the bottom of the material to be packed, namely a tray-forming packaging material strip and a top hoop packaging material strip. The end product comprising separated strips is in contrast to the integral wrapping system of the present invention.

Arrays of packs of flexible articles can also be wrapped in plastic foil. The plastic foil can comprise relatively inexpensive materials such as polymeric films or thermoplastic films. Nevertheless, problems exist concerning the severity of the disposal problem from an environmental standpoint both with respect to the amount of wrapping material required and the disposability/degradability of the particular wrapping material. Paper offers an attractive alternative by being fully biodegradable and recyclable.

The prior art therefore does not teach an integral wrapping system which eliminates the need for cardboard and plastic foil as a packaging material, which is independent of fixed dimensioned cases and which exploits the compressibility of an array of packs to form a stable unit.

OBJECT AND SUMMARY OF THE INVENTION

The object of the present invention is to provide a package for compressed flexible articles such as disposable absorbent diapers, sanitary articles, incontinent pads or briefs, bandages and the like comprising a flexible paper covering, which functions as a strong, stable and protective outer casing for the array of packs of flexible articles.

In another aspect of the invention, a process for wrapping a paper covering under tension around the array of packs of compressed flexible articles is described.

The present invention eliminates cardboard and plastic foil as a packaging material by making use of a flexible paper covering, which is wrapped under tension around a substantial part of an array of packs of compressed flexible articles. This subsequently leads to several benefits namely, the creation of a strong and protective outer casing for the array of packs of flexible articles; a reduction in the overall weight of the packages to be handled, stored and transported; a decrease in the level of waste packaging material; an increase in the level of recyclable material and an improved and optimised pallet fit during handling, storage and transport operations.

In accordance with the object of the invention, a package comprising an array of at least two substantially parallelepipedal packs comprising compressed flexible articles is provided. The package has a top and a bottom panel and four side panels. The package also comprises a flexible paper covering, which is disposed adjacent to the whole of the bottom panel and a substantial part of the side panels corresponding to at least 30 percent of the height H of the array. The paper covering on the bottom panel can comprise either four diagonal fold lines and an attachment means or a completely uninterrupted panel. For the paper covering on the bottom panel comprising four diagonal fold lines, one of the side panels comprises a seam and an attachment means and for the paper covering on the bottom panel comprising the completely uninterrupted panel, each of the side panels perpendicular to the direction of compression comprise two fold lines and an attachment means. The paper covering is held under tension around the array so as to create a strong and protective outer casing for the array and the paper covering is preferably of a basis weight of less than 200 grams per square meter. The package may comprise a least one unobstructed opening feature in the side panels. For stability purposes, when stacking packages on top of each other to form a unit in such a manner that the top panel of the flexible bags of the arrays of the packs are placed in contact with the paper covering of the bottom panel of the arrays of packs, adhesive or adhesive sheets can be used.

The underlying principle of the wrapping process is described and it can be modified to encompass the different wrapping embodiments.

According to the present invention, the objects are achieved by a package and a process having the characteristics specified in the claims.

BRIEF DESCRIPTION OF THE DRAWINGS

The invention will be described hereinafter with reference to the following drawings:

FIG. 2 is a perspective view of an array of five packs and a flexible paper covering with folding occurring on the bottom panel;

FIG. 2A is a perspective view of the paper covering of FIG. 2 without the array and prior to folding;

FIG. 3 is a perspective side view of an alternative configuration of an array of five packs and a flexible paper covering with folding occurring on the side panels;

FIG. 3A is a perspective view of the paper covering of FIG. 3 without the array.

DETAILED DESCRIPTION OF THE INVENTION

Figure 1:
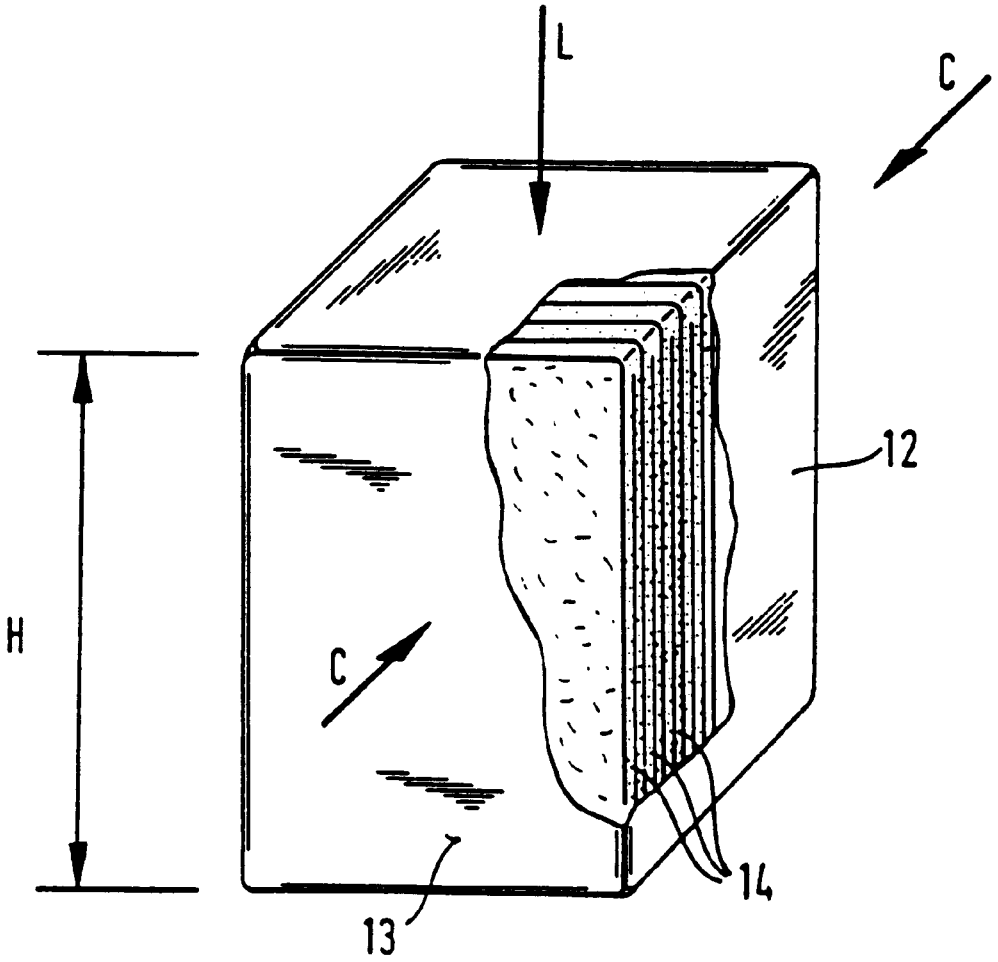
FIG. 1 shows a pack comprising compressed flexible articles encased in a flexible bag.
Figure 4:
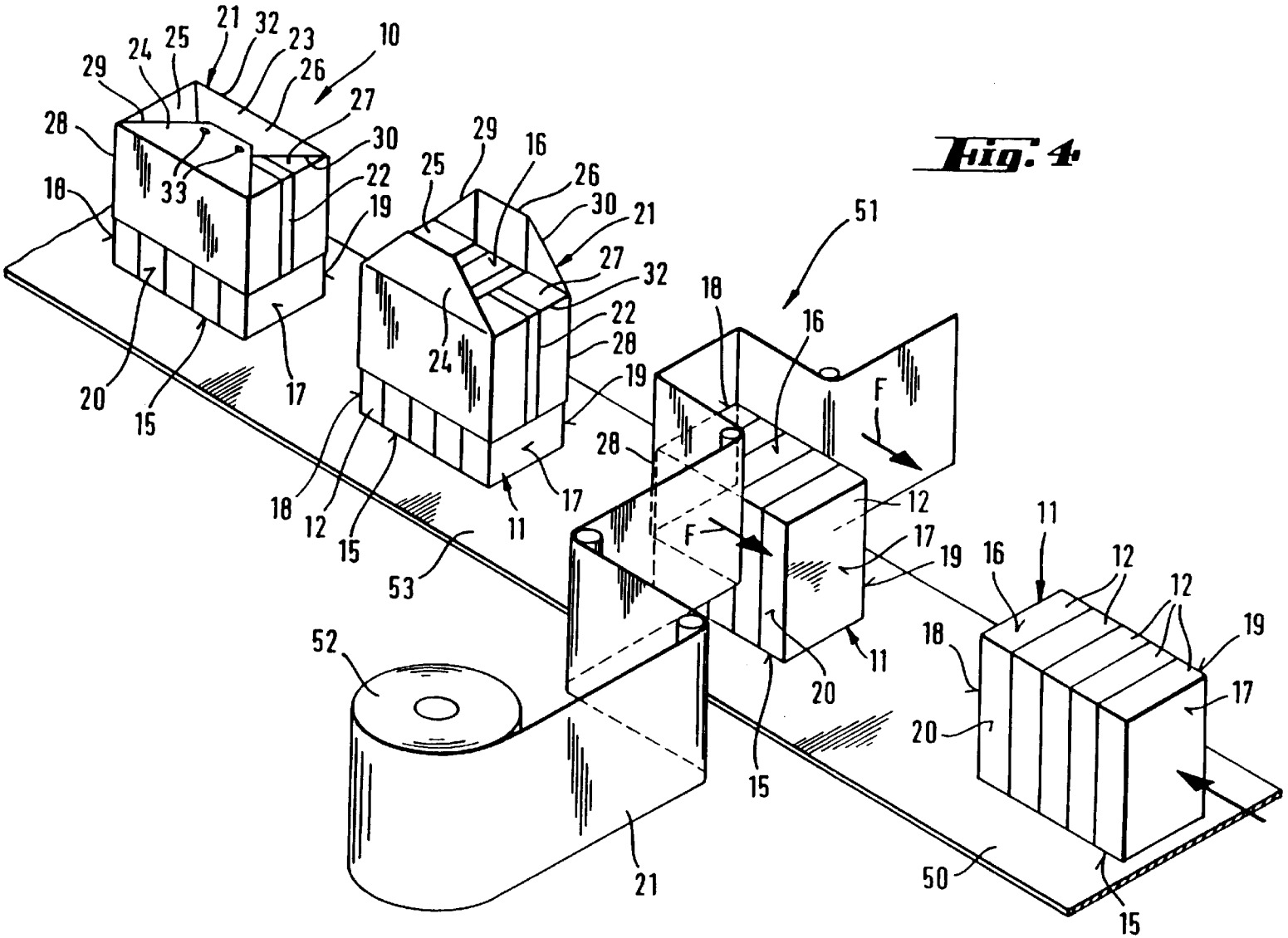
FIG. 4 details a perspective view of the process for the package described in FIG. 2.

FIG. 1 shows a pack 12 comprising compressed flexible articles 14 encased in a flexible bag 13. The substantially parallelepipedal packs 12 are arranged in an up-on-base configuration. Other configurations such as flat-on-face and up-on-side are also possible. The compressed flexible articles 14 may comprise disposable absorbent diapers, sanitary articles, incontinent pads or briefs, bandages and the like. The flexible articles 14 are compressed to between 20 and 70 percent of their uncompressed volume in a direction of compression C. In particular, FIG. 1 shows a diaper pack 12 comprising between eight and fifty disposable absorbent diapers 14 and a plastic bag 13 with a thickness ranging from 30 to 120 micrometers. A method for the compression packing of disposable absorbent diapers into flexible bags has been described in detail in the following patents U.S. Pat. Nos. 4,934,535, 4,966,286, 5,022,216, 5,050,742 and 5,150,561.

As is displayed in FIG. 2, the packs 12 are arranged in the form of an array 11 before transport and storage. An array 11 usually comprises at least two substantially parallelepipedal packs 12. More specifically, FIG. 2 shows a perspective view of a substantially covered array 11 comprising five substantially parallelepipedal packs 12 of the type shown in FIG. 1. The substantially covered array forms the package 10. For the purposes of transport and storage, a number of packages 10 can be stacked or grouped in a plurality of configurations to form a unit on a pallet such that a load L is applied to a top panel or to a side panel of the unit with the direction of the load L being perpendicular to the direction of compression C, which is around the circumference of the unit. The packages are less compressible in directions perpendicular to the direction of compression C.

In FIG. 2, the package 10 comprises a top panel 15, a bottom panel 16 and side panels 17, 18, 19, 20. The package 10 also comprises a paper covering 21, which is wrapped around the side panels 17, 18, 19, 20 of the array 11 of height H and maintained in a fixed configuration by a seam 22 on one of the side panels 17, 18, 19, 20. The paper covering can be selected from, for example, kraft, virgin kraft or recycled paper and can have a basis weight of less than 200 grams per square meter and more preferably in the range from 80 to 130 grams per square meter. The paper covering 21 does not extend more than 5 percent and preferably not more than 0.5 percent in length when being wrapped around the array 11 of packs 12.

The paper covering 21 has a height which corresponds to at least 30 percent of the height H of the array 11. This percentage can vary depending on how the packs are configured in the array 11 whether flat-on-face, up-on-base or up-on-side. For the first configuration, a height H of 65 percent is possible, but 70 percent is preferred. For the remaining two configurations, a height H of 30 percent is possible, but 70 percent is preferred. By tightly wrapping the paper covering under tension around the array 11 of packs 12 such that a reduction in the circumference occurs in the range from 3–5 percent, the stability of the array 11 is improved without resulting in a deterioration of the substantially parallelepipedal shape of the array 11. Furthermore, a strong and protective outer casing for the array 11 is created, which guarantees stability.

The paper covering 21, as shown in FIG. 2A, which shows the paper covering 21 of the FIG. 2 without the array 11 and prior to folding, comprises a section 23 that lies below the bottom panel 16 of the array 11. The section 23 of the paper covering 21 comprises four subsections 24, 25, 26, 27 bounded by fold lines 32 and joined to one another by corner fold lines 28. The subsections 24 and 26 comprise two diagonal fold lines 29, 30 extending from the corner fold line 28 to a free edge 31. The subsections 25, 27 are folded along the fold line 32, which coincides with the lower peripheral edge of the array 11. The subsections 24, 26 are folded along the fold line 32 and along the diagonal fold lines 29, 30 to form an overlapping section on the bottom panel 16. The fold lines of the subsections 24, 26 are maintained in a fixed configuration by an attachment means 33. The attachment means 33 may comprise any variety of means such as stapling, welding, adhesion, bonding, gluing or mechanical fastening. For example, adhesive strips, beads or patches of adhesive comprising a hot melt adhesive are suitable.

FIG. 3 shows a perspective side view of a different embodiment with regard to the paper covering 21' of a substantially covered array 11' comprising five substantially parallelepipedal packs 12' of the type shown in FIG. 1. FIG. 3A shows the paper covering 21' of FIG. 3 without the array 11'. A paper covering 21' is wrapped around the bottom panel 16' and folded along the fold lines 32' to form a completely uninterrupted bottom panel 16'. The fold lines 32' coincide with the lower peripheral edge of the array 11'. The paper covering 21' is of an area approximately 30 percent greater than the area of the bottom panel 16' to be covered. The subsections 34', 35' are subsequently wrapped against the side panels 19', 20' of the array 11' of the package 10'; the subsections 34' and 35' having a height which comprises at least 30 percent, preferably 70 percent of the height H of the array. This is also applicable to the up-on-side configuration. For the flat-on-face configuration, 65 percent is possible, but 70 percent is preferred. The subsections 36', 37' comprise diagonal fold lines 38', 39' extending from the corner of the free edge 41' to the fold line 32'. The subsections 36' and 37' are folded along the fold line 32' and along the diagonal lines to cover a substantial part of the height of the side panels 17', 18'. In addition, the triangular gusset folds shown behind subsections 36', 37' can also be folded onto the side panels 19', 20' and tucked underneath the subsections 34', 35'. Furthermore, the direction of the folds at each corner of the free edge 41" can all be oriented in one direction as shown or in different directions. The fold lines of the subsections 36', 37' are maintained in a fixed configuration by an attachment means 33'.

The paper covering 21' may also comprise the optional feature of an unobstructed opening feature 42', which is readily located and which can be easily and reliably opened in order to gain easy access to the packs 12' within the array 11' of the package 10' for price marking and display purposes. The paper covering 21' comprises at least one unobstructed opening feature 42', which may comprise a predetermined tear portion in the form of a line of weakness. Lines of weakness can be formed by many means well known in the art and typically comprise, for example, perforations. In addition, the unobstructed opening feature 42' may comprise a plastic thread in conjunction with a tear tab, which is located on the surface of the paper covering 21'. The combination of the plastic thread and the tear tab does not result in any weakening of the paper covering 21'. The unobstructed opening features are preferably positioned on the paper covering 21' in a substantially spaced relation to each other and are generally in the form of a thumb shape though other shapes are possible. Typical dimensions for the diameter range from 20–60 millimeters. In addition, graphical indicia may be provided on the paper covering 21' to highlight the location of the opening feature 42'.

According to the other aspect of the invention, a process for wrapping the array 11 of packs 12 with a paper covering 21 to form the package 10 encompassing the embodiments described above is provided. In general, the process involves the following steps:

a) supplying the array 11 of packs 12 on a feed conveyor 50 to a packaging station 51;

b) pulling a paper covering 21 from a supply roll 52;

c) feeding the paper covering 21 to the packaging station 51;

d) moving the array 11 along the packaging station 51 transverse to the paper covering 21 onto a discharge conveyor 53 in such a manner that the bottom 16 and side panels 17, 18, 19, 20 are surrounded with the paper covering 21;

e) applying the attachment means 33 in the appropriate manner to form the package 10.

More particularly, the array 11 to be wrapped is moved along the packaging station 51 towards the paper covering 21 (consider, for example, that the side panel 18 faces the paper covering 21), which is transverse to the path of movement of the array 11.

A pusher clamp is used to hold the array 11 in place. The paper covering 21 is wrapped around the array 11 in a U-shape and pulled by means of a pull force F such that the two edges of the side panel 17 of the array 11 are deformed. A pusher plate pushes on the upper panel 15 of the array 11 to prevent the paper covering 21 from slipping backwards. The third edge of the side panel 18 is deformed with a metal plate. The action of the metal plate results in the formation of round edges and produces the same effect as the paper covering 21 does by means of the pull force F. The pusher clamp retreats. The fourth edge of the side panel 18 is deformed with a roller. The circumference of the array 11 is reduced by at least 3 percent depending on the product and the size of the array 11. The paper covering 21 is cut perpendicular to the direction of the paper feed and the final step involves the application of an attachment means 33 with the aid of a roller. The pusher plate retreats. At least three edges of the array 11 have to be deformed before the application of the attachment means 33. The deformed edges act like springs and keep the paper covering 21 under tension and thus, ensure the stability of the package 10.

This represents the underlying principle of the wrapping process and can be modified to take account of the different wrapping configurations described herein. Furthermore, the process can be used both to completely wrap an array of packs to form a package and a stack or grouping of packages to form a unit.

For ease of handling, transport and storage, the packages 10, wrapped according to the present invention, are stacked in a plurality of configurations to form a unit disposed on a pallet. Glue or adhesive coated sheets can be employed to stabilise the unit. In particular, pressure sensitive glue, as supplied by Actio-pack® of Germany, is sprayed on the top panel 15 of the flexible plastic bags 13 of the arrays 11 of packs 12 and placed in contact with the paper covering 21 of the bottom panel 16 of the arrays 11 of packs 12. In order to minimise the quantity of glue on the plastic bags 13 and to maintain sufficient unit stability, glue beads of approximately 3 centimeters diameter located close to the corners of the package 10 are employed. Alternatively, adhesive coated palletisation insert sheets Stop Gliss®, as supplied by END-UPACK of France, are disposed between the packages to ensure stability. The same anti-slip compound can be coated on both sides of the palletisation insert sheets or different anti-slip compounds can be coated on each side to meet the frictional/stabilising requirements of each material.

Glossary

| | |
|---|---|
| 10 | package |
| 11 | array |
| 12 | pack |
| 13 | flexible bag |
| 14 | compressed articles |
| 15 | top panel |
| 16 | bottom panel |
| 17, 18, 19, 20 | side panels |
| 21 | paper covering |
| 22 | seam |
| 23 | section |
| 24, 25, 26, 27 | subsections |
| 28 | corner fold line |
| 29, 30 | diagonal fold lines for 26, 27 |
| 31, 41 | free edges |
| 32 | fold line |
| 33 | attachment means |
| 34, 35, 36, 37 | subsections |
| 38, 39 | diagonal fold lines for 36, 37 |
| 42 | unobstructed opening feature |
| 50 | feed conveyor |
| 51 | packaging station |
| 52 | supply roll |
| 53 | discharge conveyor |

We claim:

1. A package comprising an array of at least two substantially parallelepipedal packs, said packs comprising compressed flexible articles encased in a flexible bag, said compressed flexible articles having been compressed to between 20 percent and 70 percent of their uncompressed volume in a direction of compression C, said array comprising a top panel, a bottom panel and four side panels, characterised in that a flexible paper covering is disposed adjacent the whole of said bottom panel and a substantial part of said side panels corresponding to at least 30 percent of height H of said array, said paper covering being held under tension around said array so as to create a strong and protective outer casing for said array.

2. A package according to claim 1 wherein said paper covering adjacent said bottom panel comprises four diagonal fold lines and an attachment means to maintain said diagonal lines in a fixed configuration.

3. A package according to claim 1 wherein said paper covering adjacent one of said side panels comprises a seam and an attachment means to maintain said seam in a fixed configuration.

4. A package according to claim 2 wherein said paper covering adjacent one of said side panels comprises a seam and an attachment means to maintain said seam in a fixed configuration.

5. A package according to claim 1 wherein said paper covering adjacent said bottom panel comprises a completely uninterrupted panel.

6. A package according to claim 5 wherein said paper covering adjacent each of said side panels perpendicular to the direction of compression C comprises two fold lines and an attachment means to maintain said fold lines in a fixed configuration.

7. A package according to claim 1 wherein said paper covering comprises paper of a basis weight of less than 200 grams per square meter.

8. A package according to claim 1, wherein said paper covering comprises an unobstructed opening feature in said paper covering adjacent one of said side panels.

9. A package according claim 1, wherein said compressed flexible articles are disposable absorbent diapers, sanitary articles, incontinent pads or briefs, or bandages.

10. A process for producing a package according to claim 1 comprising the following steps:

a) said array of said packs to be packed is supplied on a feed conveyor to a packaging station;

b) said paper covering is pulled off a supply roll;

c) said paper covering is fed to said packaging station;

d) said array is moved along said packaging station transverse to said paper covering and onto a discharge conveyor in such a manner that said bottom panel and said side panels of said array are surrounded with said paper covering;

e) an attachment means for maintaining said paper covering in a fixed configuration is applied.

11. A process for producing a package according to claim 10 wherein at least three edges of said array are deformed before said attachment means are applied.

12. A process for producing a package according to claim 1 wherein at least three edges of said array are deformed before said attachment means are applied.

13. A process for producing a package according to claim 2 wherein at least three edges of said array are deformed before said attachment means are applied.

14. A process for producing a package according to claim 3 wherein at least three edges of said array are deformed before said attachment means are applied.

15. A process for producing a package according to claim 11 wherein circumference of said array is reduced by at least 3 percent.

16. A process for producing a package according to claim 12 wherein circumference of said array is reduced by at least 3 percent.

17. A process for producing a package according to claim 13 wherein circumference of said array is reduced by at least 3 percent.

18. A process for producing a package according to claim 14 wherein circumference of said array is reduced by at least 3 percent.

* * * * *